United States Patent [19]

Wu

[11] Patent Number: 5,063,953

[45] Date of Patent: Nov. 12, 1991

[54] QUICKLY OPENABLE UMBRELLA WITH MULTIPLE FOLDS

[76] Inventor: Kuei-Jen Wu, c/o Hung Hsing Patent Service Center, P.O. Box 55-1670, Taipei (10477), Taiwan

[21] Appl. No.: 691,737

[22] Filed: Apr. 26, 1991

[51] Int. Cl.[5] ..... A45B 19/00

[52] U.S. Cl. ..... 135/25.3; 135/31

[58] Field of Search ..... 135/25.3, 25.31, 31, 135/27, 25.32, 15.1, 25.1

[56] References Cited

U.S. PATENT DOCUMENTS

| | | | |
|---|---|---|---|
| 1,264,010 | 4/1918 | Calusinski | 135/25.3 |
| 3,850,188 | 11/1974 | Saito | 135/22 X |
| 4,658,844 | 4/1987 | Ping | 135/25.3 |
| 4,739,783 | 4/1988 | Yang | 135/25.3 |
| 4,815,489 | 3/1989 | Yang | 135/25.3 |
| 4,966,180 | 10/1990 | Lai | 135/25.3 |

FOREIGN PATENT DOCUMENTS

| | | | |
|---|---|---|---|
| 2632337 | 12/1989 | France | 135/31 |
| 3809873 | 10/1989 | German Democratic Rep. | 135/25.3 |
| 470853 | 4/1952 | Italy | 135/31 |

*Primary Examiner*—David A. Scherbel
*Assistant Examiner*—Lan Mai

[57] ABSTRACT

An umbrella includes a plurality of ribs for securing an umbrella cloth thereon having at least an intermediate top rib integrally formed with an inner section provided with a downwardly-opened groove in the inner section and an outer section provided with an upwardly-opened groove in the outer section for foldably receiving an inner flexible reinforcing rib into the inner section and for foldably receiving an outer flexible reinforcing rib into the outer section, of which a flexible reinforcing rib is flexibly fastened by a coupling to the intermediate top rib for exerting an elastic force for quickly opening the umbrella for decreasing the chances subjected to attacks by wind or external forces.

7 Claims, 8 Drawing Sheets

QUICKLY OPENABLE UMBRELLA WITH MULTIPLE FOLDS

BACKGROUND OF THE INVENTION

A conventional multiple-fold umbrella, as shown in Taiwan Patent Gazzette Page 155 of Aug. 16, 1984 issue, with a publication No. 60693, and an application No., 7228751 filed on: 12/21/1983, disclosed a plurality of ribs forming several parallelograms for tensioning the ribs for opening or closing the umbrella, which however may subject to strong wind pressure or external force acting upon the parallelograms with increased surface area, thereby being vulnerably twisted, bent, deformed or even broken.

The present inventor has found the drawbacks of such a conventional multiple-fold umbrella, and invented the present umbrella quickly openable for decreasing the chances of being attacked by wind pressure or external force when opening the umbrella.

SUMMARY OF THE INVENTION

The object of the present invention is to provide an umbrella including a plurality of ribs for securing an umbrella cloth thereon having at least an intermediate top rib integrally formed with an inner section provided with a downwardly-opened groove in the inner section and an outer section provided with an upwardly-opened groove in the outer section for foldably receiving an inner flexible reinforcing rib into the inner section and for foldably receiving an outer flexible reinforcing rib into the outer section, of which a flexible reinforcing rib is flexibly fastened by a coupling to the intermediate top rib for exerting an elastic force for quickly opening the umbrella for decreasing the chances subjected to attacks by wind or external forces.

DETAILED DESCRIPTION

Figure 1:
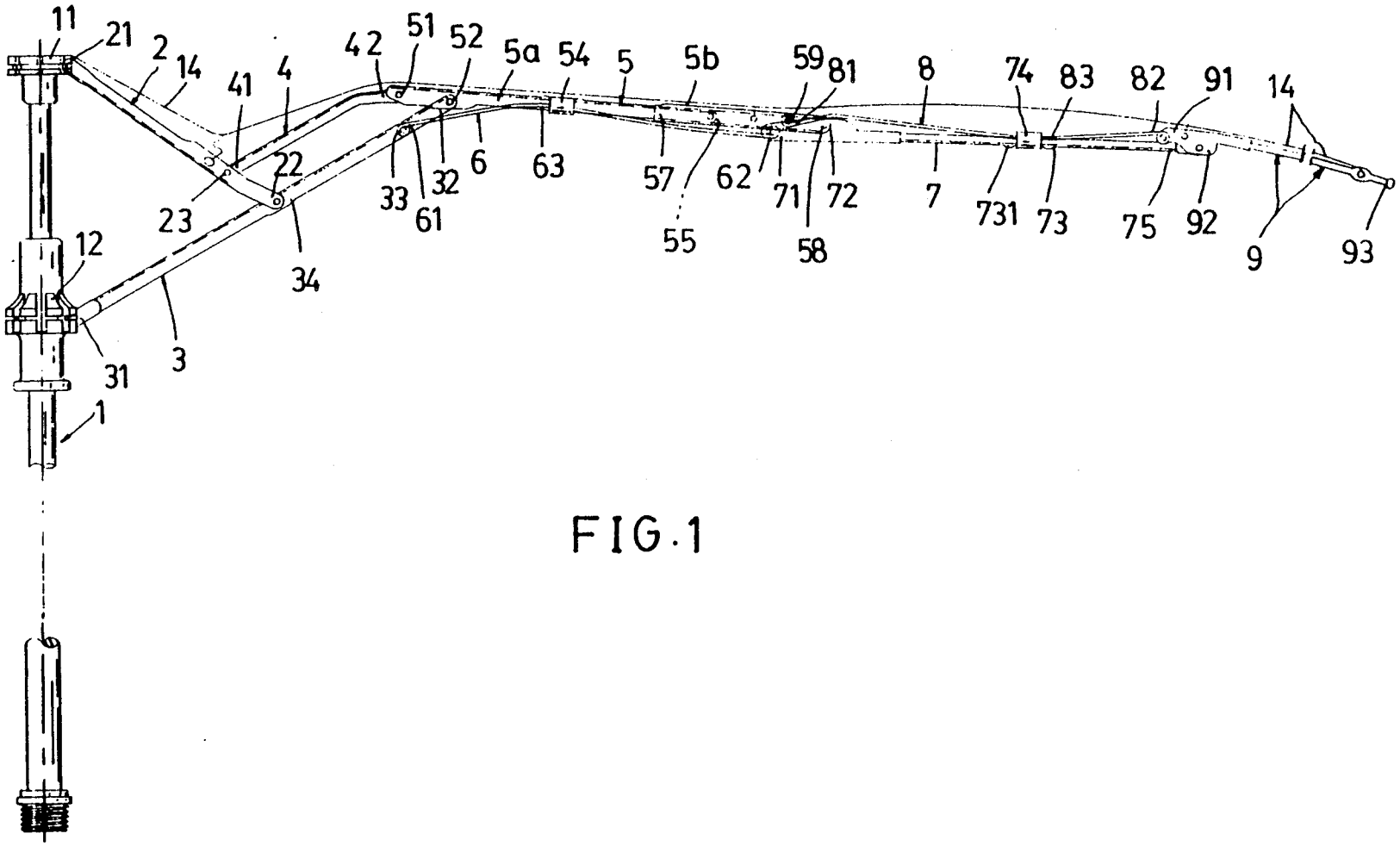
FIG. 1 is an illustration showing an opening step of the present invention.
Figure 2:
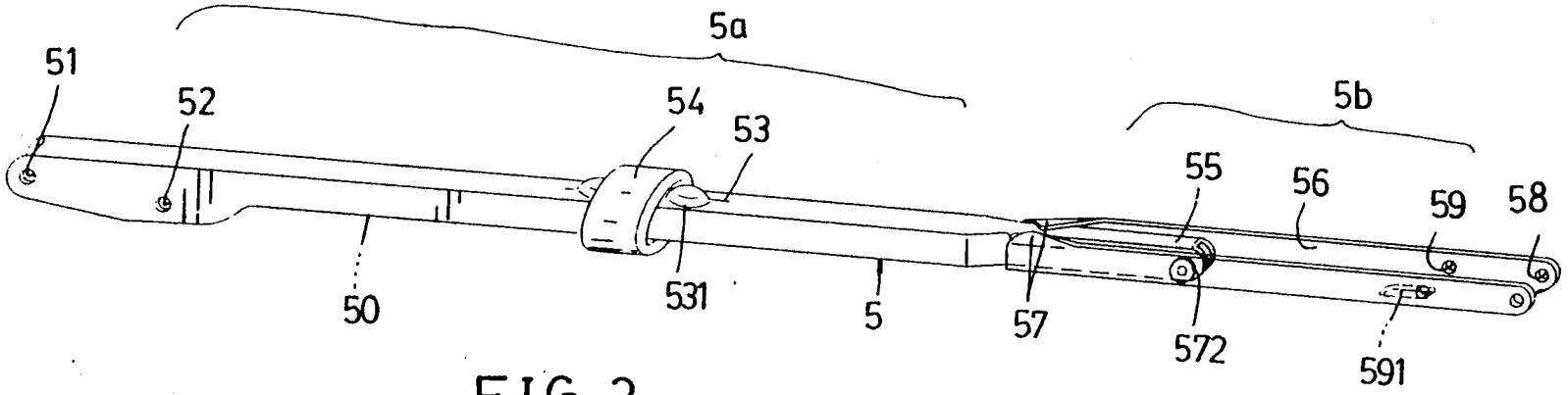
FIG. 2 is a perspective view of a first intermediate top rib of the present invention.
Figure 3:
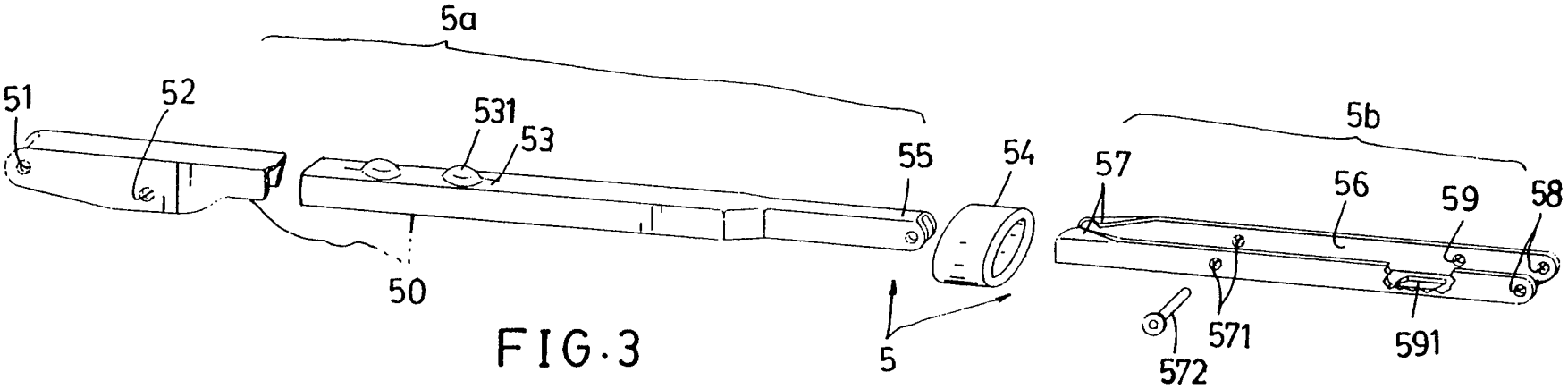
FIG. 3 is an exploded view of the first intermediate top rib of the present invention.
Figures 4, 5:
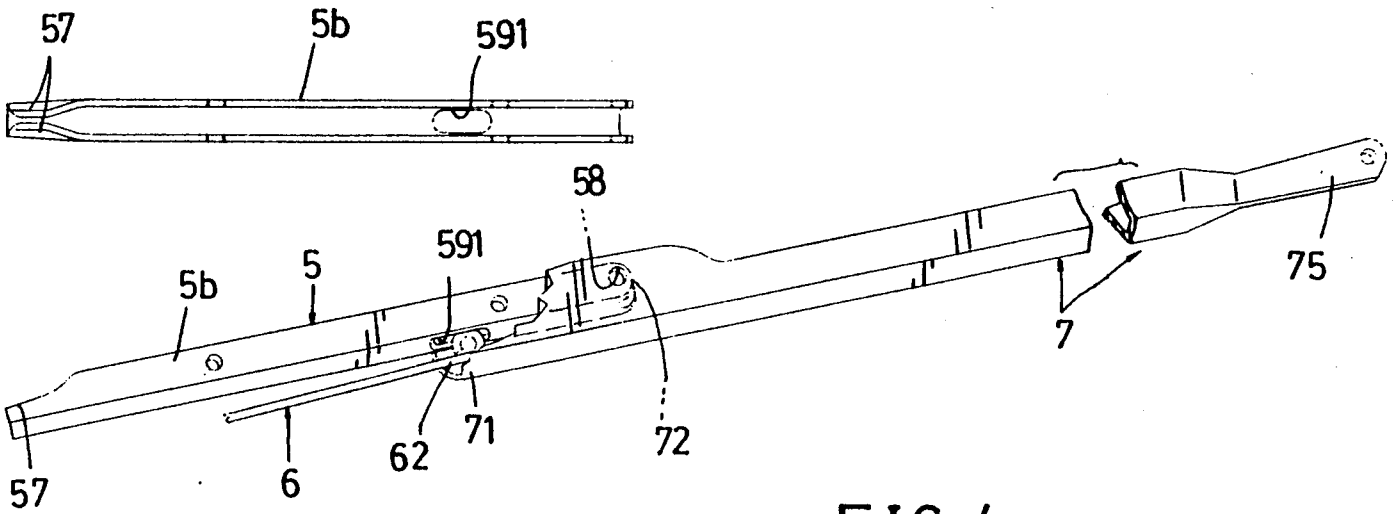
FIG. 4 shows a connection of partial ribs of the present invention.
FIG. 5 shows an outer section of the first intermediate top rib.

As shown in FIGS. 1–7, the present invention comprises: a central shaft 1 having an upper notch 11 formed on an upper portion of the shaft 1 and a lower runner 12 slidably held on the shaft 1, an inner top rib 2, a stretcher rib 3, an inner linking rib 4, a first intermediate top rib 5, an inner flexible reinforcing rib 6, a second intermediate top rib 7, an outer flexible reinforcing rib 8, an outer top rib 9 and an umbrella cloth 14 secured on all the ribs.

The inner top rib 2 has its inner end portion 21 pivotally secured to the upper notch 11 and has a first outer end portion 22 of the top rib 2 formed on an outermost end of the rib 2 secured to a middle portion 34 of the stretcher rib 3.

The stretcher rib 3 has its inner end portion 31 pivotally secured to the lower runner 12, and a first outer end portion 32 formed on an outermost end of the rib 3 pivotally secured to a second inner end portion 52 of the first intermediate top rib 5 next to a first inner end portion 51 formed on an innermost end of the top rib 5.

The inner linking rib 4 has its inner end portion 41 pivotally secured to a second outer end portion 23 of the inner top rib 2 next to a first outer end portion 22 of the rib 2, and has an outer end portion 42 pivotally secured to a first outer end portion 51 of the first intermediate top rib 5.

The first intermediate top rib 5 has its first outer end portion 58 formed on an outermost end of the rib 5 pivotally secured to a second inner end portion 72 of the second intermediate top rib 7 next to a first inner end portion 71 formed on an innermost end of the rib 7.

The inner flexible reinforcing rib 6 has its inner end portion 61 pivotally secured to a second outer end portion 33 next to the first end portion 32 of the stretcher rib 3.

The second intermediate top rib 7 has the first inner end portion 71 pivotally secured to an outer end portion 62 of the inner flexible reinforcing rib 6, and an outer end portion 75 of the rib 7 pivotally secured to a second inner end portion 92 of the outer top rib 9 next to a first inner end portion 91 formed on an innermost end of the top rib 9.

The outer flexible reinforcing rib 8 has its inner end portion 81 pivotally secured to a second outer end portion 59 next to the first outer end portion 58 of the rib 5, and has an outer end portion 82 of the rib 8 pivotally secured to the first inner end portion 91 of the outer top rib 9. The outer top rib 9 has an outer end portion 93 secured with an outer rim of the umbrella cloth 14.

The outer flexible reinforcing rib 8 has its middle portion 83 slidably retained in a second coupling 74 fastened on a central portion 73 of the second intermediate top rib 7. The coupling 74 may be stably embedded in between two protrusions 731 formed on the central portion 73 of the rib 7.

The first intermediate top rib 5 includes: an inner section **5*a* having a downwardly-opened groove 50 formed in the inner section 5*a* with a cross section generally inversed-U-shaped, and an outer section 5*b* partially combinably secured with the inner section 5*a* having an upwardly-opened groove 56 with a cross section generally U shaped. An outer end portion 55 of the inner section 5*a* is secured with an inner end portion 57 of the outer section 5*b* by a rivet 572 inserted through rivet holes 571 formed in the inner end portion 57. A slot 591 is formed in a second outer end portion 59 next to the first outer end portion 58 of the outer section 5*b* pivotally secured to the outer end portion 72 of the top rib 7. The slot 591 is adapted for receiving the inner end portion 81 of the outer flexible reinforcing rib 8** when folding the umbrella. The downwardly-opened groove 50 of the inner section 5a is provided to foldably receive the inner flexible reinforcing rib 6 when folding the umbrella, while the upwardly-open groove 56 of the outer section 5b is provided for foldably receiving the outer flexible reinforcing rib 8 as shown in FIG. 7.

The first intermediate top rib 5 includes two protrusions 531 formed on a middle portion 53 of the rib 5 for retaining a first coupling 54 formed as a loop fastened on the middle portion 53 of the rib 5 to slidably hold the inner flexible reinforcing rib 6 in the downwardly-opened groove 50 of the inner section 5a of top rib 5.

Figure 7:
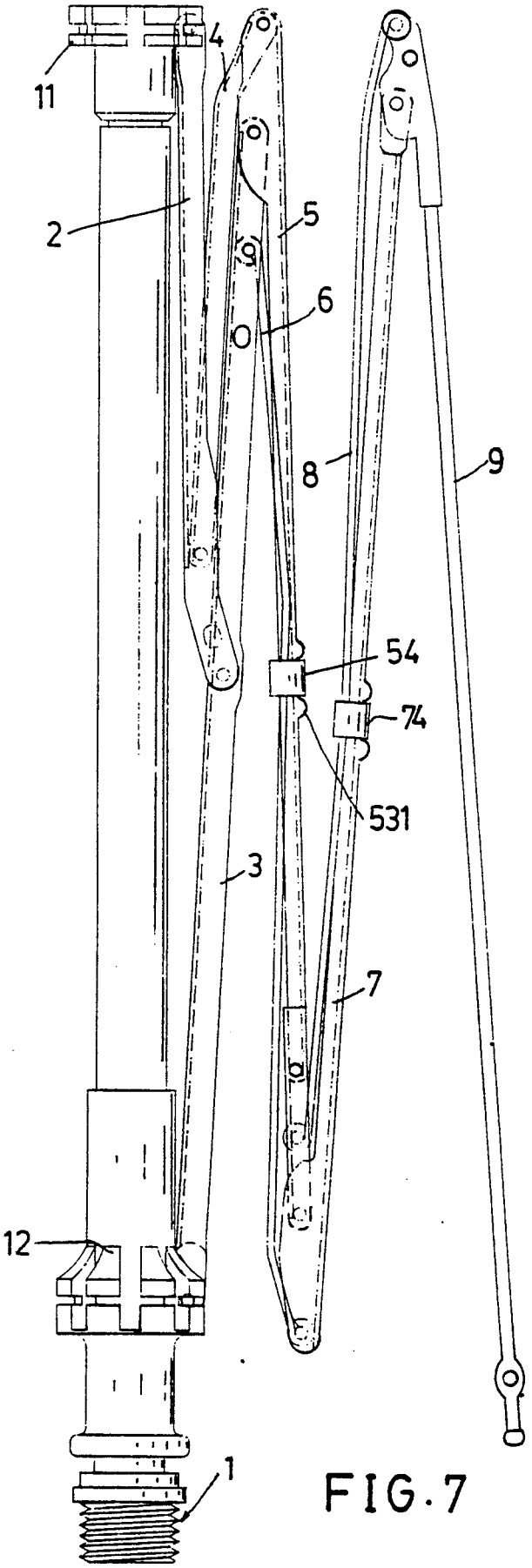
FIG. 7 shows a folded umbrella of the present invention.

When the umbrella of the present invention is folded as shown in FIG. 7, the lower runner 12 is lowered to fold all the ribs 2–9 to straighten the two flexible reinforcing ribs 6, 8 to be partially received into the grooves of the two sections 5a, 5b of the first intermediate top rib 5.

Figure 6:
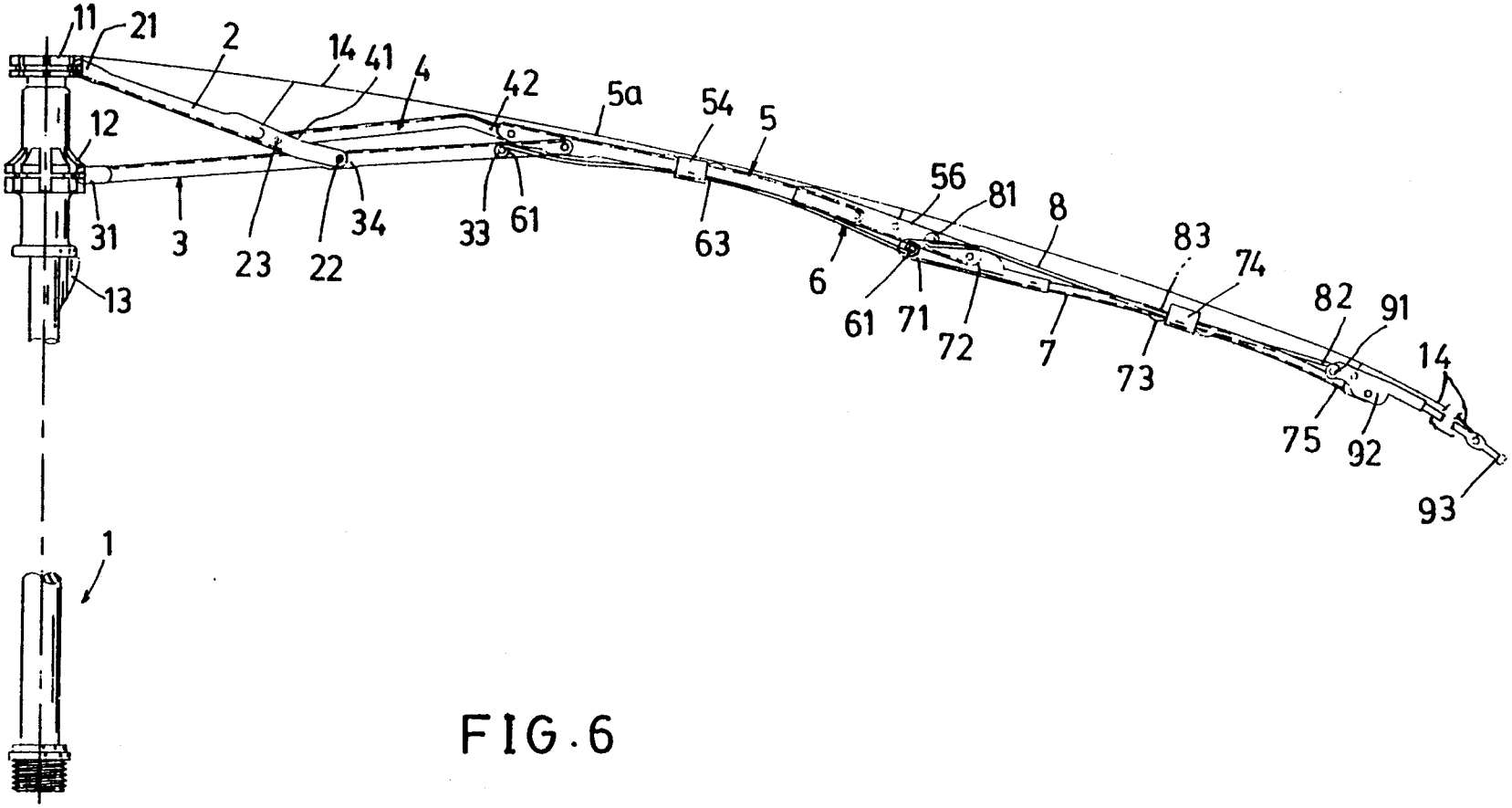
FIG. 6 shows an opened umbrella of the present invention.

For opening the umbrella, the lower runner 15 is raised from FIG. 7 to shorten a distance between the upper notch 11 and the runner 12 to extend the ribs, and the inner flexible reinforcing rib 6 having its middle portion 63 slidably held by the first coupling 54 fastened on the first intermediate top rib 5 will be bent to store its elastic energy, and the outer flexible reinforcing rib 8 having a middle portion 83 of the outer flexible rib 8 slidably held by a second coupling 74 fastened on the middle portion 73 of the second intermediate top rib 7 will also be bent to store its elastic energy. The runner 12 is continuously raised in order to straighten the ribs 5, 7, 9 to be generally linear of their configuration. During the straightening of the ribs 5, 7, 9 to be a linear configuration, the ribs are accelerated to be resiliently tensioned and extendibly straightened as urged by the elastic force of the two reinforcing ribs 6, 8 which are releasing their elastic energy from a bending state to a linear state, before the umbrella cloth 14 being tensioned to be fully opened. Further raising of the lower runner 12 will fully open the umbrella cloth 14, of which a tension caused by an arcuate opened umbrella cloth 14 will also help the ribs extend stably as retained by the runner 12 locked on a catch 13 resiliently formed in the shaft 1 as shown in FIG. 6.

Accordingly, the umbrella of the present invention can be quickly opened to decrease a transition period for opening an umbrella so as to shorten the umbrella-opening time to decrease the probability subjected to attacks by strong wind pressure or external force for a safer protection of the umbrella.

Meanwhile, the two flexible reinforcing ribs 6, 8 can be received or partially received by the two sections 5a, 5b of the top rib 5 for minimizing a volume of a folded, beneficial for its handling and storage.

Figure 8:
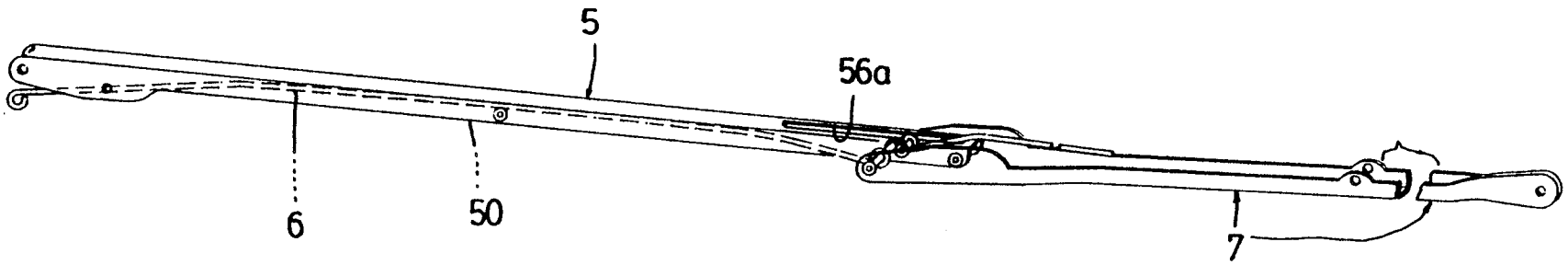
FIG. 8 shows another preferred embodiment of the present invention.
Figure 9:
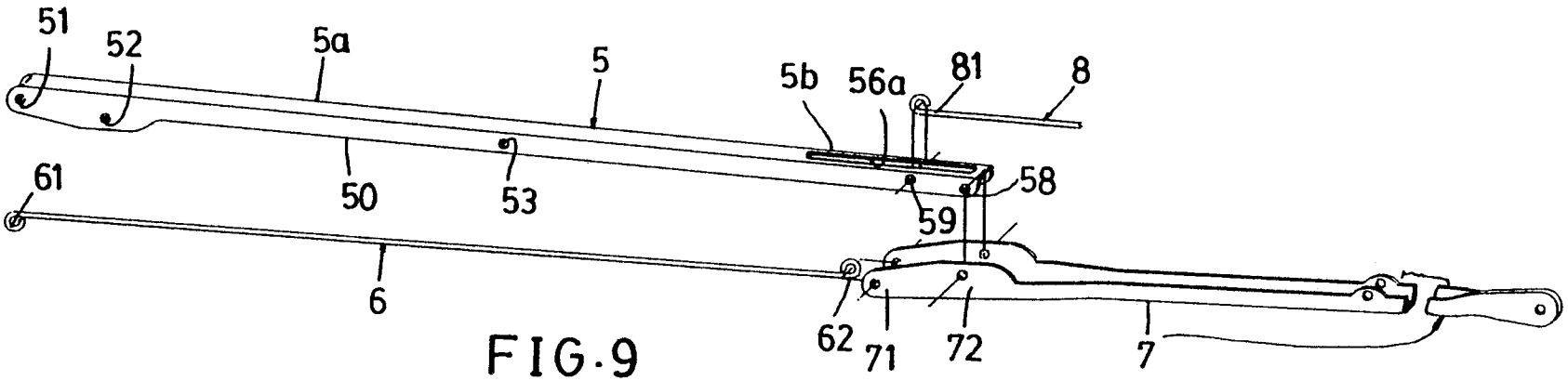
FIG. 9 is an exploded view of FIG. 8 of the present invention.

Another preferred embodiment of the present invention is shown in FIGS. 8, 9 in which the inner section 5a and the outer section 5b of the first intermediate top rib 5 are integrally formed by directly punching an upwardly-opened slot 56a in an upper portion of the outer section 5b to substitute the aforementioned upwardly-opened groove 56.

Figure 11:
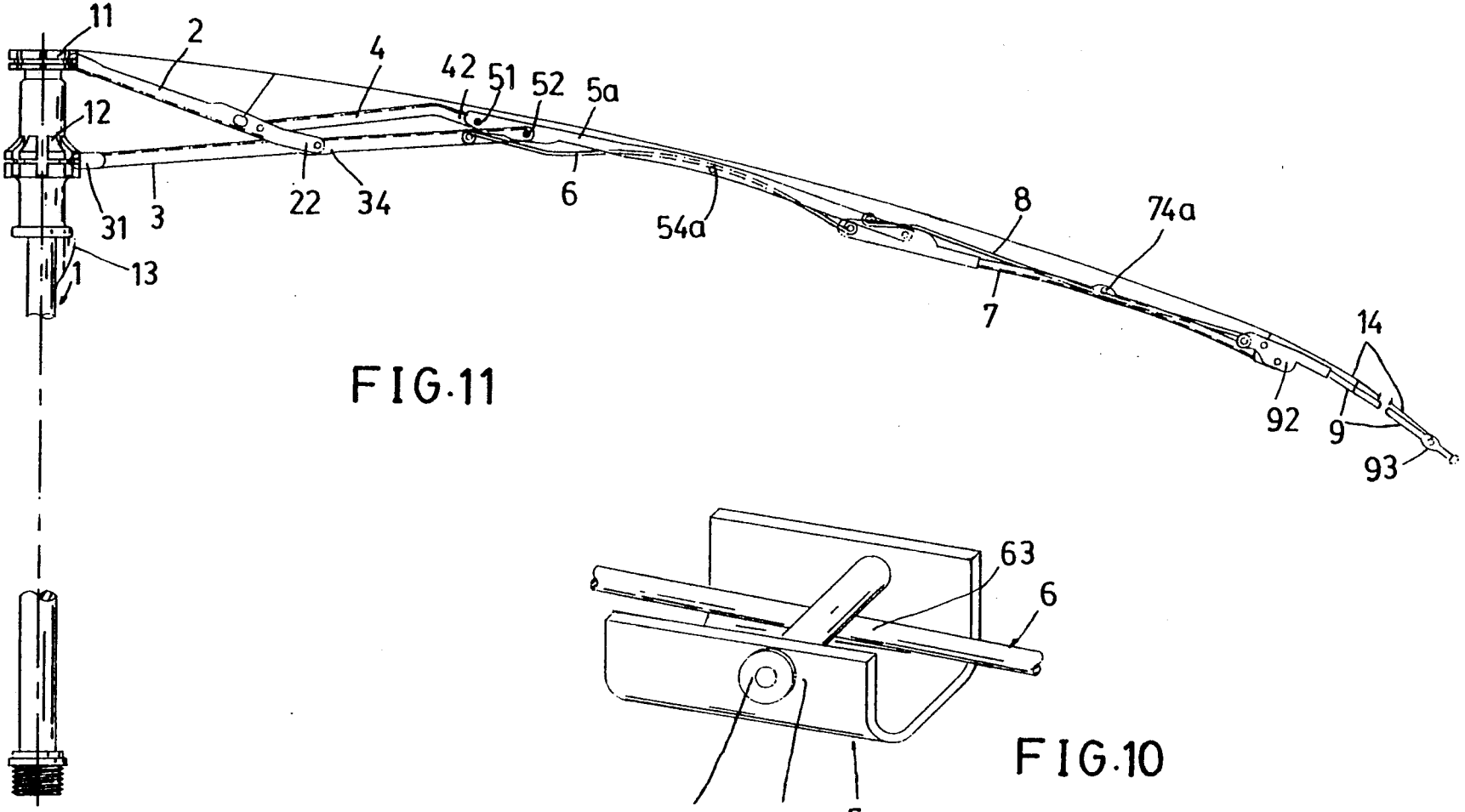
FIG. 11 shows an opened umbrella of the present invention having the coupling as shown in FIG. 10.
Figure 10:
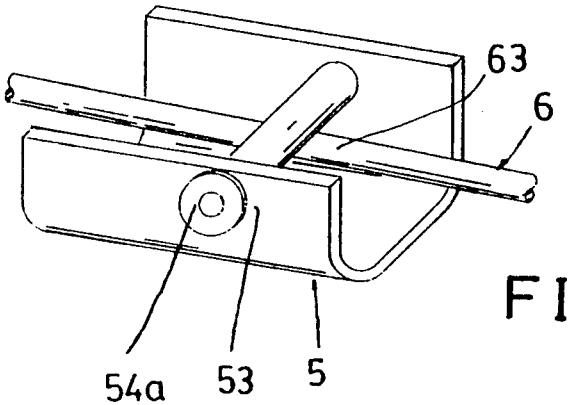
FIG. 10 is a perspective view of a coupling of the present invention.
Figure 12:
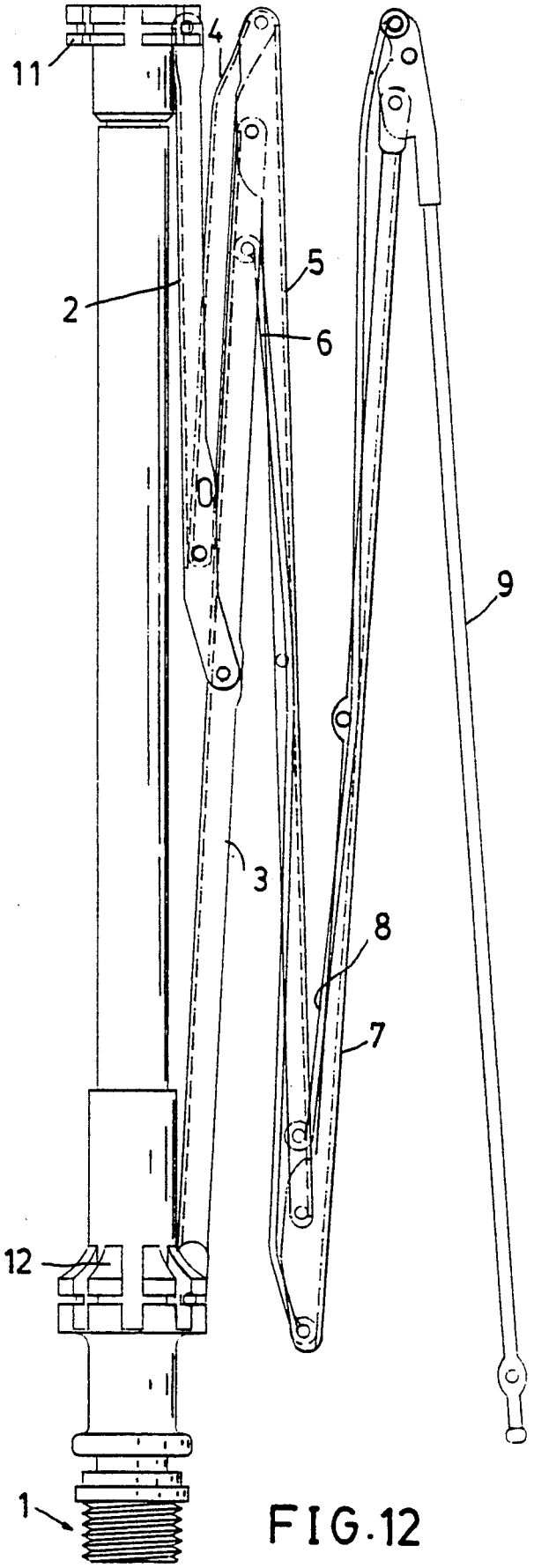
FIG. 12 shows a closed umbrella folded from FIG. 11.

As shown in FIGS. 10–12, the first and second couplings 54, 74 are respectively modified to be two pins 54a transversely secured to a middle portion 53 of the rib 5 and a middle portion 73 of the rib 7 to substitute a loop type coupling 54, 74 as mentioned hereinbefore.

From the aforementioned, the second coupling 74 or 74a may be omitted to reserve the first coupling 54 or 54a for slidably holding the inner reinforcing rib 6 to the first intermediate top rib 5. Alternatively, if the first coupling 54 or 54a is eliminated, the second coupling 74 or 74a may be provided for slidably holding the outer reinforcing rib 8 to the second intermediate top rib 7.

I claim:

1. An umbrella comprising:

an inner top rib pivotally secured to an upper notch formed on an upper portion of a central shaft;

a stretcher rib pivotally secured to a lower runner slidably held on said central shaft;

an inner linking rib pivotally secured to an outer portion of the inner top rib;

a first intermediate top rib pivotally secured to said inner linking rib and said stretcher rib;

an inner flexible reinforcing rib pivotally secured to said stretcher rib;

a second intermediate top rib pivotally secured to said first intermediate top rib and said inner flexible reinforcing rib;

an outer flexible reinforcing rib pivotally secured to said first intermediate top rib;

an outer top rib pivotally secured to said second intermediate top rib and said outer flexible reinforcing rib; and an umbrella cloth secured on a plurality of said top ribs;

the improvement which comprises:

said first intermediate top rib including an inner section having a downwardly-opened groove with a cross section of generally inversed-U-shaped for foldably receiving said inner flexible reinforcing rib into said downwardly-opened groove; and an outer section partially combinably secured with said inner section having an upwardly-opened groove with a cross section generally U shaped for foldably receiving said outer flexible reinforcing rib;

said inner flexible reinforcing rib having its middle portion slidably held in a first coupling fastened on a middle portion of said first intermediate top rib; and said outer flexible reinforcing rib having a middle portion of said outer reinforcing rib slidably held in a second coupling fastened on a middle portion of said second intermediate top rib.

2. An umbrella according to claim 1, wherein said inner section of said first intermediate top rib is integrally formed with said outer section of said first intermediate top rib.

3. An umbrella according to claim 2, wherein said outer section of said first intermediate top rib is directly punched to form an upwardly-opened slot in an upper portion of said outer section.

4. An umbrella according to claim 1, wherein each said coupling is formed with a loop fastened on said top rib for slidably holding each said flexible reinforcing rib between said loop and said top rib.

5. An umbrella according to claim 1, wherein each said coupling is formed with a pin transversely secured in said top rib for slidably holding each said flexible reinforcing rib between said pin and said top rib.

6. An umbrella comprising:

an inner top rib pivotally secured to an upper notch formed on an upper portion of a central shaft;

a stretcher rib pivotally secured to a lower runner slidably held on said central shaft;

an inner linking rib pivotally secured to an outer portion of the inner top rib;

a first intermediate top rib pivotally secured to said inner linking rib and said stretcher rib;

an inner flexible reinforcing rib pivotally secured to said stretcher rib;

a second intermediate top rib pivotally secured to said first intermediate top rib and said inner flexible reinforcing rib;

an outer flexible reinforcing rib pivotally secured to said first intermediate top rib;

an outer top rib pivotally secured to said second intermediate top rib and said outer flexible reinforcing rib; and an umbrella cloth secured on a plurality of said top ribs;

the improvement which comprises:

said first intermediate top rib including an inner section having a downwardly-opened groove with a cross section of generally inversed-U-shaped for foldably receiving said inner flexible reinforcing rib into said downwardly-opened groove; and an outer section partially combinably secured with said inner section having an upwardly-opened groove with a cross section generally U shaped for foldably receiving said outer flexible reinforcing rib; and said inner flexible reinforcing rib having its middle portion slidably held in a first coupling fastened on a middle portion of said first intermediate top rib.

7. An umbrella comprising:

an inner top rib pivotally secured to an upper notch formed on an upper portion of a central shaft;

a stretcher rib pivotally secured to a lower runner slidably held on said central shaft;

an inner linking rib pivotally secured to an outer portion of the inner top rib;

a first intermediate top rib pivotally secured to said inner linking rib and said stretcher rib;

an inner flexible reinforcing rib pivotally secured to said stretcher rib;

a second intermediate top rib pivotally secured to said first intermediate top rib and said inner flexible reinforcing rib;

an outer flexible reinforcing rib pivotally secured to said first intermediate top rib;

an outer top rib pivotally secured to said second intermediate top rib and said outer flexible reinforcing rib; and an umbrella cloth secured on a plurality of said top ribs;

the improvement which comprises:

said first intermediate top rib including an inner section having a downwardly-opened groove with a cross section of generally inversed-U-shaped for foldably receiving said inner flexible reinforcing rib into said downwardly-opened groove; and an outer section partially combinably secured with said inner section having an upwardly-opened groove with a cross section generally U shaped for foldably receiving said outer flexible reinforcing rib; and said outer flexible reinforcing rib having a middle portion of said outer reinforcing rib slidably held in a second coupling fastened on a middle portion of said second intermediate top rib.

* * * * *